United States Patent [19]

Fenne

[11] Patent Number: 4,524,799

[45] Date of Patent: Jun. 25, 1985

[54] DELIVERY VALVES

[75] Inventor: Ivor Fenne, North Greenford, England

[73] Assignee: Lucas Industries public limited company, Birminghan, England

[21] Appl. No.: 502,162

[22] Filed: Jun. 8, 1983

[30] Foreign Application Priority Data

Jul. 15, 1982 [GB] United Kingdom ..... 8220493

[51] Int. Cl.[3] ..... F02M 39/00; F02M 59/02

[52] U.S. Cl. ..... 137/516.27; 137/614.18; 123/446; 123/467

[58] Field of Search ..... 123/467, 446; 137/614.18, 516.27

[56] References Cited

U.S. PATENT DOCUMENTS

| | | | |
|---|---|---|---|
| 3,439,705 | 4/1969 | Simko | 137/516.27 |
| 3,742,926 | 7/1973 | Kemp | 123/467 |
| 3,908,621 | 9/1975 | Hussey | 123/467 |
| 4,074,668 | 2/1978 | Indra | 123/467 |
| 4,099,894 | 7/1978 | Indra | 417/499 |
| 4,437,443 | 3/1984 | Hofbauer | 123/467 |
| 4,478,189 | 10/1984 | Fenne | 123/446 |

*Primary Examiner*—A. Michael Chambers

[57] ABSTRACT

A delivery valve for use in a fuel injection system of an internal combustion engine comprises a valve body defining a bore in which is slidably mounted a valve member which is biased towards one end of the bore by a coiled compression spring.

A first circumferential groove in the bore communicates with the one end of the bore and a second groove on the valve member communicates with the first groove and is exposed beyond the other end of the bore when the valve is opened to allow fuel flow past the valve. The valve member is moved by fuel pressure at the one of the bore and the extent of movement of the valve member against the action of the spring is limited.

5 Claims, 1 Drawing Figure

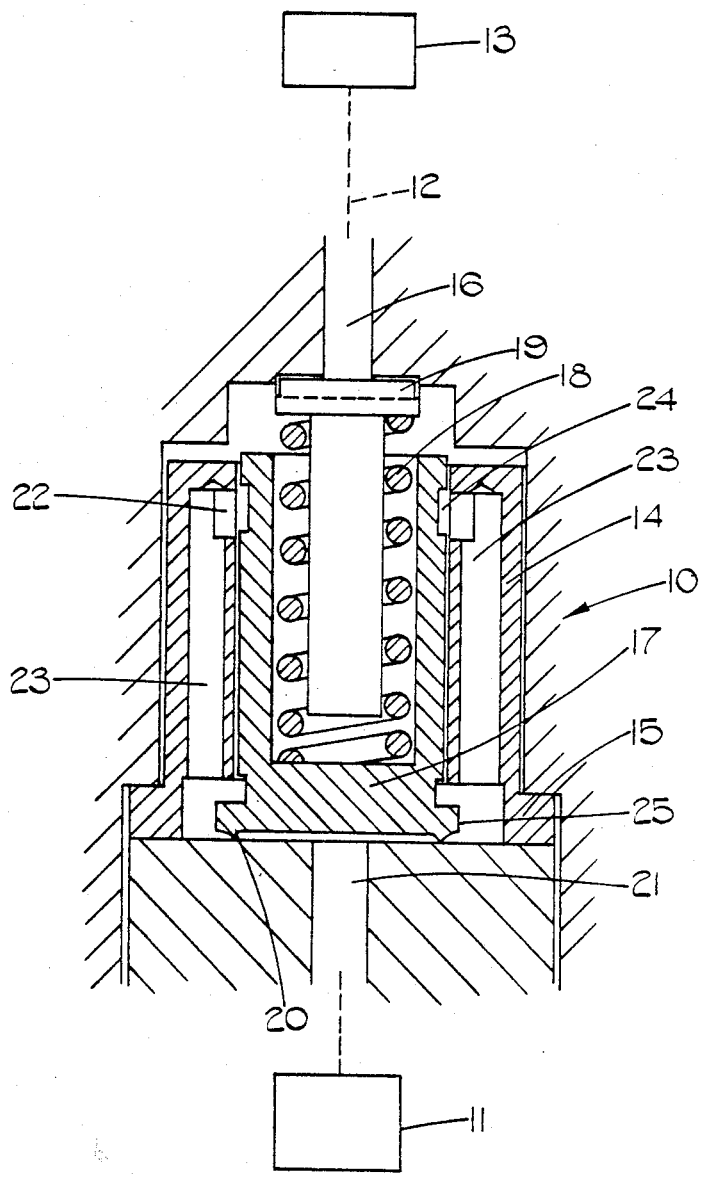
13
12
16
19
18
24
23
22
14
10
17
23
15
25
21
20
11

DELIVERY VALVES

This invention relates to delivery valves for use with fuel injection systems for compression ignition engines.

Delivery valves are well known in the fuel injection system art and are provided in or adjacent the outlet of a fuel injection pump so as to be disposed at the upstream end of a pipeline connecting the outlet to an injection nozzle. The purpose of the valve is to trap fuel under pressure in the pipeline at the end of the delivery of fuel by the pump. It is usual however to allow a predetermined volume of fuel to flow from the pipeline to the outlet of the pump when delivery of fuel by the pump ceases. The type of delivery valve which permits such flow of fuel is known in the art as an unloading delivery valve and the main purpose of the return flow of fuel is to allow a pressure responsive valve in the nozzle to close quickly.

The most common form of unloading delivery valve has a spring loaded valve member with a poppet type head, a cylindrical portion located adjacent the head and a fluted stem, the valve member being located in a bore formed in a delivery valve body. One end of the bore communicates with the pumping chamber of the fuel pump and the other end of the bore defines a seating for engagement by the valve head. The cylindrical portion is slidable in the bore and in use, during delivery of fuel the cylindrical portion is urged out of the bore to allow fuel flow from the bore to the associated pipeline. When the delivery of fuel ceases the spring urges the cylindrical portion back into the bore and the displacement of the cylindrical portion as it moves back into the bore and until the head engages the seating, is a measure of the amount of fuel allowed to flow from the pipeline this being known in the art as the unloading volume.

The spring of the delivery valve is subject to considerable stress and in order to reduce the velocity attained by the valve member at the commencement of fuel delivery and hence reduce the stresses to which the spring is subjected, the diameter of the valve member can be increased. If the axial length of the cylindrical portion remains the same it is clear that the unloading volume will increase. The axial length of the cylindrical portion can be reduced to reduce the unloading volume but there is a practical limit to the extent of reduction possible. Moreover, it is conventional practice to provide an undercut between the valve head and the cylindrical portion in order to facilitate machining of the valve member and this undercut contributes to the unloading volume. In general therefore if the diameter of the valve member is increased to reduce the velocity of the valve member, the unloading volume is increased and this is an undesirable feature.

The object of the present invention is to provide a delivery valve in a simple and convenient form.

According to the invention a delivery valve for use in a fuel injection system for a compression ignition engine comprises in combination, a delivery valve body defining a bore, a valve member slidable in the bore, resilient means loading the valve member in a direction towards one end of the bore to prevent flow through the valve, a first groove formed in the wall of the bore adjacent the other end thereof, a second groove defined on the valve member said first groove being placed in communication with the outlet of the pump when the valve member moves against the action of the resilient means, said second groove being in register with the first groove but being exposed beyond the other end of the bore to allow fuel flow through the valve when the valve member has moved a predetermined extent in a direction away from said one end of the bore.

An example of a delivery valve in accordance with the invention will now be described with reference to the accompanying drawing which shows the delivery valve in sectional side elevation.

Referring to the drawing the delivery valve is indicated at 10 and is located between the outlet of a fuel injection pump 11 and a pipeline 12 which connects the pump 11 to an injection nozzle 13. The injection nozzle is of the type which includes a pressure responsive resiliently loaded valve member.

The delivery valve comprises a delivery valve body 14 which is of annular form and which for convenience, is provided with a peripheral flange 15 which is trapped between two surfaces defined on components which form part of the injection pump 11. The delivery valve body is located within a chamber from which extends a passage 16 which is connected to the pipeline 12.

Slidable within the bore formed in the delivery valve body is a valve member 17 which is of cup-shaped form. The valve member is biased by means of a coiled compression spring 18 located between an abutment 19 in the chamber and the interior surface of the base wall of the valve member. The outer face of the base wall of the base member defines an annular projection 20 which can seat against a surface defined by one of the aforesaid parts of the injection pump, the projection when seated on said surface, surrounding the entrance of a passage 21 constituting the outlet of the injection pump.

Formed in the wall of the bore in which the valve member is located, is a circumferential groove 22 and this by means of passages 23, which extend axially within the body 14 communicates with a space surrounding the projection 20. The groove 22 constitutes a first groove and a second groove 24 is formed on the peripheral surface of the valve member. The first and second grooves are in constant communication with each other but during movement of the valve member against the action of its spring, the groove 24 is exposed beyond the delivery valve body. The extent of such movement is limited by the abutment of an outwardly extending flange 25 on the base wall of the valve member, with the adjacent end surface of the valve body 14.

In use, when fuel under pressure is delivered by the injection pump, the pressure of fuel acts upon the end surface of the valve member disposed within the projection 20 and the force developed on the valve member opposes the force generated by the spring together with the force acting on the valve member due to the pressure within the pipeline 12. When the force developed due to the pressure at the outlet of the injection pump is sufficient, the valve member lifts and the projection 20 is moved out of seating engagement with the surface of the injection pump. As soon as this occurs, the groove 22 is placed in communication with the injection pump. The valve member continues to move against the action of the spring and fuel is displaced towards the injection nozzle but it does not flow through the grooves until the groove 24 is exposed beyond the end of the delivery valve body. The movement of the valve member is brought to rest when the flange 25 engages the delivery valve body.

When delivery of fuel by the injection pump ceases, the valve member will be moved by the action of the spring towards the position shown in the drawing. The so-called unloading volume is determined by the area of the end surface of the valve member and the axial movement of the valve member which takes place after the groove 24 has been covered by the wall of the bore and until the projection 20 engages with the aforesaid surface.

With the arrangement described, the diameter of the valve member can be much larger than with a conventional form of delivery valve thereby to reduce the stroke of the valve member and hence the stresses in the spring 18. The increase in diameter of the valve member does not necessarily means that the unloading volume will be increased since it is possible to position the grooves 22 and 24 so as to maintain the unloading volume to the level required. Moreover, it will be noted that the lift of the valve member is determined by the abutment of the two main components of the delivery valve, namely the delivery valve body and the valve member. In the known form of delivery valve described earlier in the specification the lift of the valve member is limited by a stop member which is carried by a separate part of the delivery valve so that because of the provision of various gaskets etc. it is not possible to accurately locate the stop.

It will further be noted that a substantial portion of the spring which biases the valve member is housed within the valve member itself and as a result the axial length of the valve member is comparatively short as compared with the known forms of delivery valve.

I claim:

1. A delivery valve for use in a fuel injection system for a compression ignition engine comprising in combination, a delivery valve body defining a bore, a valve member slidable in the bore, resilient means biasing the valve member towards one end of said bore, a first groove defined in the wall of the bore adjacent said other end thereof, a second groove defined in the periphery of the valve member adjacent the end thereof remote from said one end of the bore, said grooves being in register with each other, a fuel flow path to said first groove which is opened when the valve member moves against said resilient means under the action of fuel under pressure, said second groove being uncovered beyond the other end of said bore after a predetermined movement of the valve member to allow fuel to flow by way of said grooves to an outlet, said predetermined movement determining the amount of fuel returned from said outlet when the valve member is moved by the action of said resilient means.

2. A delivery valve according to claim 1 in which said valve member is of cup shaped form, said resilient means being in the form of a coiled compression spring which is partly located within the valve member.

3. A delivery valve according to claim 1 in which said delivery valve body is of annular form and said first groove communicates with said one end of the bore by way of a passage formed in the wall of the body.

4. A delivery valve according to claim 1 including a flange formed on the valve member, said flange in use co-operating with the valve body to limit the extent of movement of the valve member against the action of said resilient means.

5. A delivery valve according to claim 4 in which the end surface of said valve member at said one end of the bore defines an annular projection for co-operating in use with a part defining an outlet of an injection pump, said projection in the closed position of the valve, sealingly engaging said part about said outlet.

* * * * *